US005943992A

United States Patent [19]

Kojima et al.

[11] Patent Number: 5,943,992

[45] Date of Patent: Aug. 31, 1999

[54] DECOMPRESSION MECHANISM IN ENGINE

[75] Inventors: Hiroaki Kojima; Takeshi Maeda, both of Wako, Japan

[73] Assignee: Honda Giken Kogyo Kabushiki Kaisha, Tokyo, Japan

[21] Appl. No.: 08/978,371

[22] Filed: Nov. 25, 1997

[30] Foreign Application Priority Data

Nov. 29, 1996 [JP] Japan ..... 8-318936

[51] Int. Cl.[6] ..... F01L 13/08

[52] U.S. Cl. ..... 123/182.1

[58] Field of Search ..... 123/182.1

[56] References Cited

U.S. PATENT DOCUMENTS

| | | | |
|---|---|---|---|
| 3,687,124 | 8/1972 | Kolorz | 123/182.1 |
| 3,981,289 | 9/1976 | Harkness | 123/182.1 |
| 5,085,184 | 2/1992 | Yamada et al. | 123/182.1 |
| 5,116,287 | 5/1992 | Hironaka et al. | 123/182.1 |
| 5,711,264 | 1/1998 | Jezek et al. | 123/182.1 |

FOREIGN PATENT DOCUMENTS

| | | | |
|---|---|---|---|
| 362775 | 4/1990 | Japan | 123/182.1 |
| 6-6889 | 1/1994 | Japan . | |
| 06280532 | 10/1994 | Japan | 123/182.1 |

*Primary Examiner*—Andrew M. Dolinar
*Assistant Examiner*—Arnold Castro
*Attorney, Agent, or Firm*—Nikaido, Marmelstein, Murray & Oram LLP

[57] ABSTRACT

A decompression mechanism in an engine is provided, which is constructed so that a centrifugal weight, a pivot supporting the centrifugal weight on a driven timing gear, and an operating pin adapted to transmit the swinging movement of the centrifugal weight to a decompression cam shaft, can be formed as a single piece from a single steel wire, thereby providing a reduction in cost. The centrifugal weight is formed into a bow-like shape from a steel wire, and a pivot and a pin are formed by bending the steel wire sideways from opposite ends of the centrifugal weight.

3 Claims, 8 Drawing Sheets

DECOMPRESSION MECHANISM IN ENGINE

BACKGROUND OF THE INVENTION

1. Field of the Invention

The present invention relates to a decompression mechanism for moderately reducing the compression pressure in a combustion chamber to thereby alleviate the operational load during the starting operation in an engine in which a cam for opening and closing an engine valve is integrally connected to one end face of a driven timing gear driven in a speed-reduced manner from a crankshaft. In particular the present invention is directed to an improvement in a decompression mechanism in an engine, including an annular recess defined in the other end face of the driven timing gear; a decompression cam shaft provided to extend from the annular recess to the cam and rotated between a first position in which a very small lift portion is formed on a base face of the cam and a second position in which the very small lift portion is retracted. A pivot is formed at the base end of a centrifugal weight accommodated in the annular recess, the pivot being fitted into a pivot bore provided in the driven timing gear. An operating pin is formed at the tip end of the centrifugal weight and engages the decompression cam shaft, so that the decompression cam shaft can be rotated from the first position to the second position by the centrifugal operation of the centrifugal weight. A decompression spring is connected to the centrifugal weight, for biasing the centrifugal weight toward the first position.

2. Description of the Prior Art

A decompression mechanism in the engine is already known, for example, as disclosed in Japanese Patent Publication No. 6-6889. In this decompression mechanism, the centrifugal weight is made of a steel plate, and the pivot and the operating pin are coupled to base and tip ends of the centrifugal weight by caulking or welding. Therefore, a number of parts are used and moreover, the manufacturing of the decompression mechanism is relatively troublesome, and it is difficult to reduce the cost.

SUMMARY OF THE INVENTION

The present invention has been accomplished with such circumstance in view, and it is an object of the present invention to provide a decompression mechanism in an engine, which is comprised of a reduced number of parts and has a simple structure and hence, is inexpensive.

To achieve the above object, according to a first aspect and feature of the present invention, the decompression mechanism comprises an annular recess defined in an end face of a driven timing gear. A cam for opening and closing an engine valve is connected to the other end face of the driven timing gear. A decompression cam shaft extends from the annular recess to the cam and is rotatable between a first position in which a very small lift portion is formed on a base face of the cam and a second position in which the very small lift portion is retracted. A pivot is formed at a base end of a centrifugal weight in the annular recess and the pivot is fitted into a pivot bore provided in the driven timing gear. An operating pin formed at a tip end of the centrifugal weight and is engaged with the decompression cam shaft, so that the decompression cam shaft can be rotated from the first position to the second position by the centrifugal operation of the centrifugal weight. A decompression spring is connected to the centrifugal weight for biasing the centrifugal weight toward the first position, wherein the centrifugal weight, the pivot bent sideways from one end of the centrifugal weight and the operating pin bent sideways from the other end of the centrifugal weight are integrally formed from a single steel wire. Thus, the centrifugal weight, the pivot and the operating pin can be formed as a single piece by bending a single steel wire.

According to a second aspect and feature of the present invention, at least one limiting wall member is integrally formed on the driven timing gear to abut against the centrifugal weight to limit the depth of the pivot into the pivot bore. Thus, even if a round angle portion is left inside a bend between the centrifugal weight and the pivot in a bending process, the round angle portion is prevented from biting into the pivot bore by the limiting wall member.

DETAILED DESCRIPTION OF THE PREFERRED EMBODIMENTS

The mode for carrying out the present invention will now be described by way of embodiments shown in the accompanying drawings.

Figure 1:
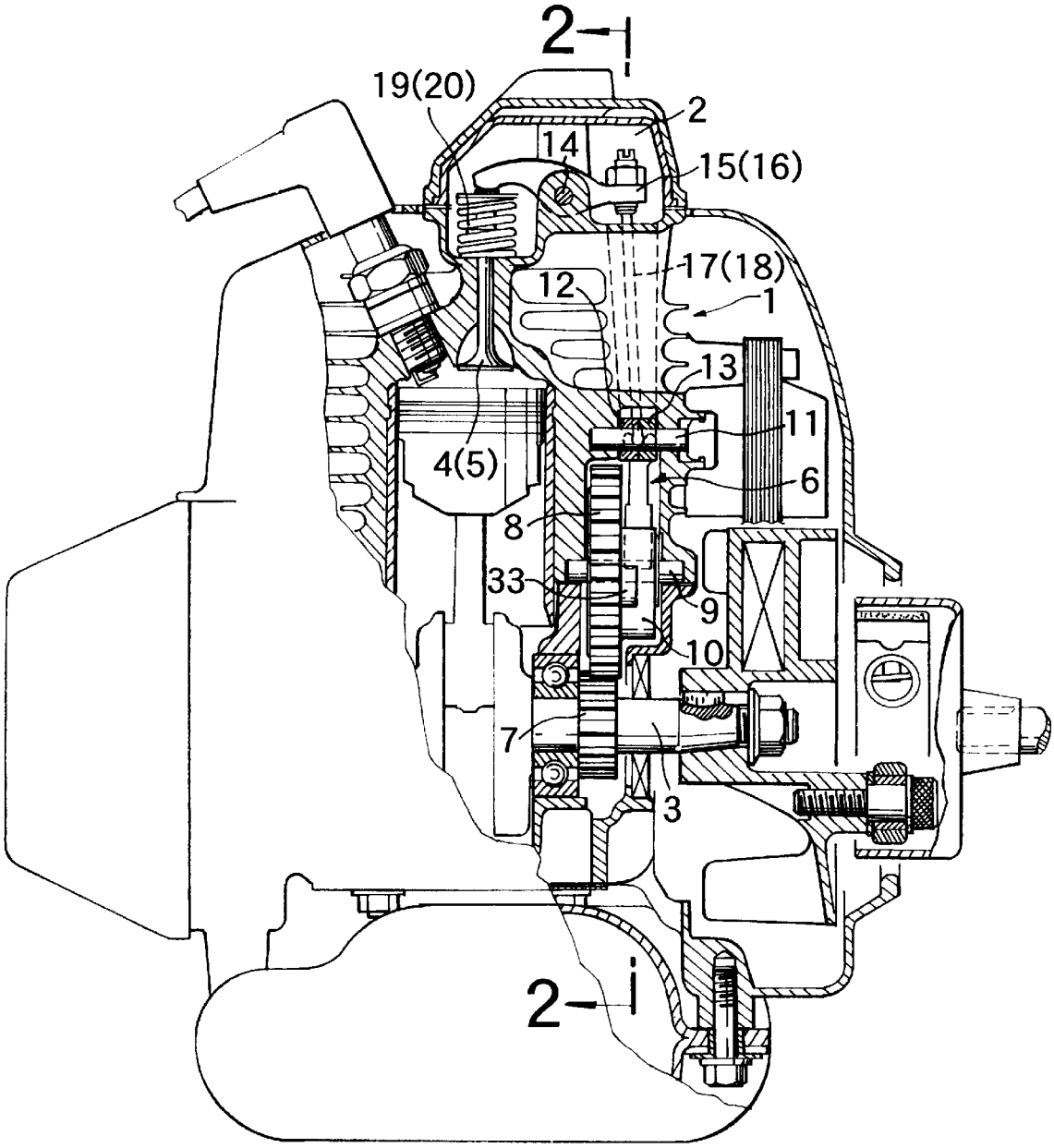
FIG. 1 is a vertical sectional front view of an essential portion of an engine equipped with a decompression mechanism according to a first embodiment of the present invention.
Figure 2:
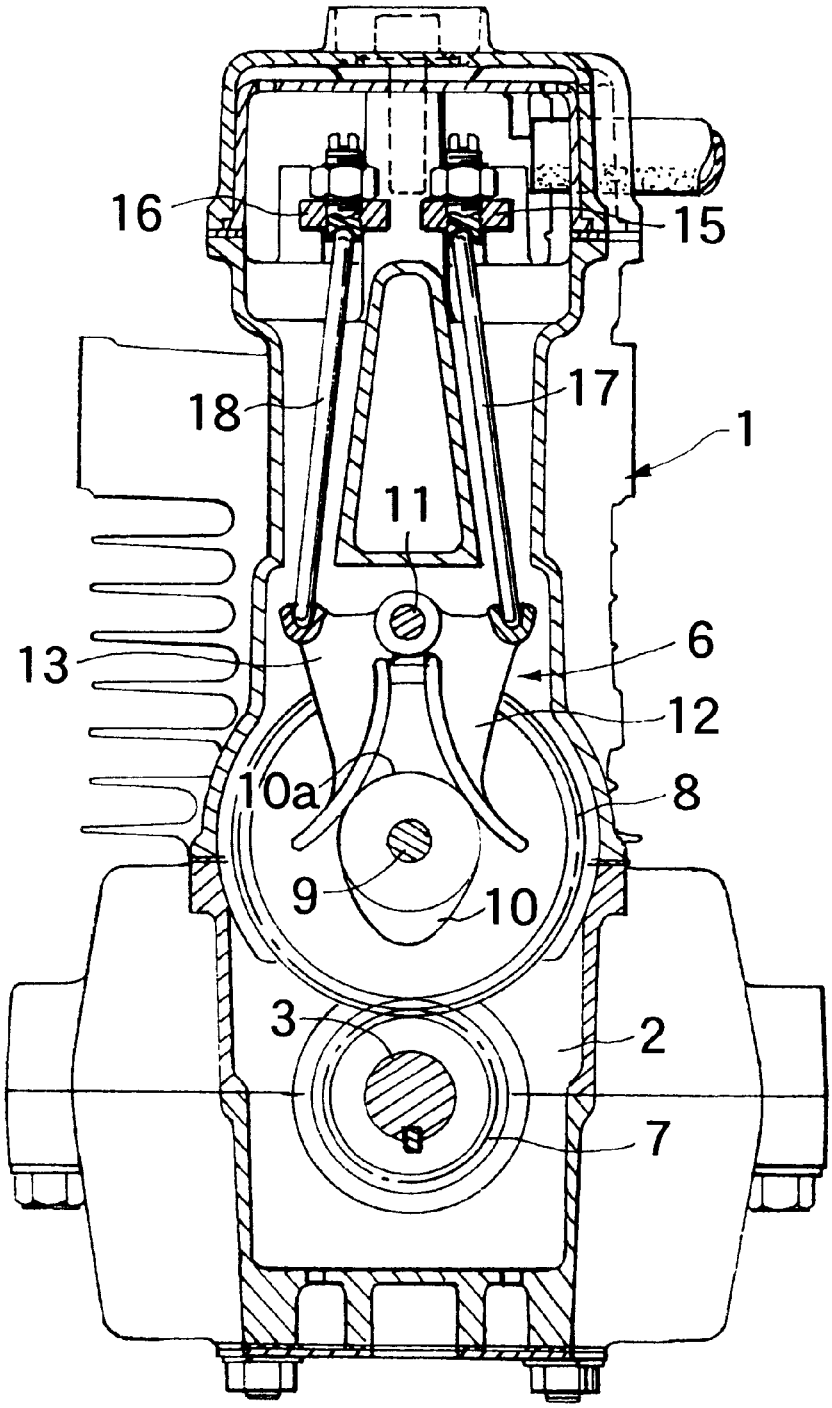
FIG. 2 is a sectional view taken along a line 2—2 in FIG. 1.

A first embodiment of the present invention will be first described with reference to FIGS. 1 to 6. In FIGS. 1 and 2, an engine body 1 is a 4-cycle engine. A valve operating device 6 is disposed in a valve operating chamber 2 formed on one side of the engine body 1 for opening and closing intake and exhaust valves 4 and 5 (engine valves) in operative association with the rotation of a crankshaft 3.

The valve operating device 6 is comprised of a driving timing gear 7 secured to the crankshaft 3, and a driven timing gear 8 carried on an intermediate shaft 9, driven at a reduction ratio of 1/2 from the driving timing gear 7. A cam 10 is integrally connected to one end of the driven timing gear 8, and a pair of cam followers 12 and 13 are carried on a cam follower shaft 11, so that they are swung by the cam 10. A pair of rocker arms 15 and 16 are carried on a rocker shaft 14 with one end thereof abutting against the valve heads of the intake and exhaust valves 4 and 5. A pair of push rods 17 and 18 connect the cam followers 12 and 13 to the other ends of the rocker arms 15 and 16, respectively, and valve springs 19 and 20 bias the intake and exhaust valves 4 and 5 in the closing directions, respectively. When a lift face of the cam 10 pushes the push rods 17 and 18 through the cam followers 12 and 13, the intake and exhaust valves 4 and 5 are opened. When a base face of the cam 10 confronts the cam followers 12 and 13, the intake and exhaust valves 4 and 5 are closed by the biasing forces of the valve springs 19 and 20.

Figure 3:
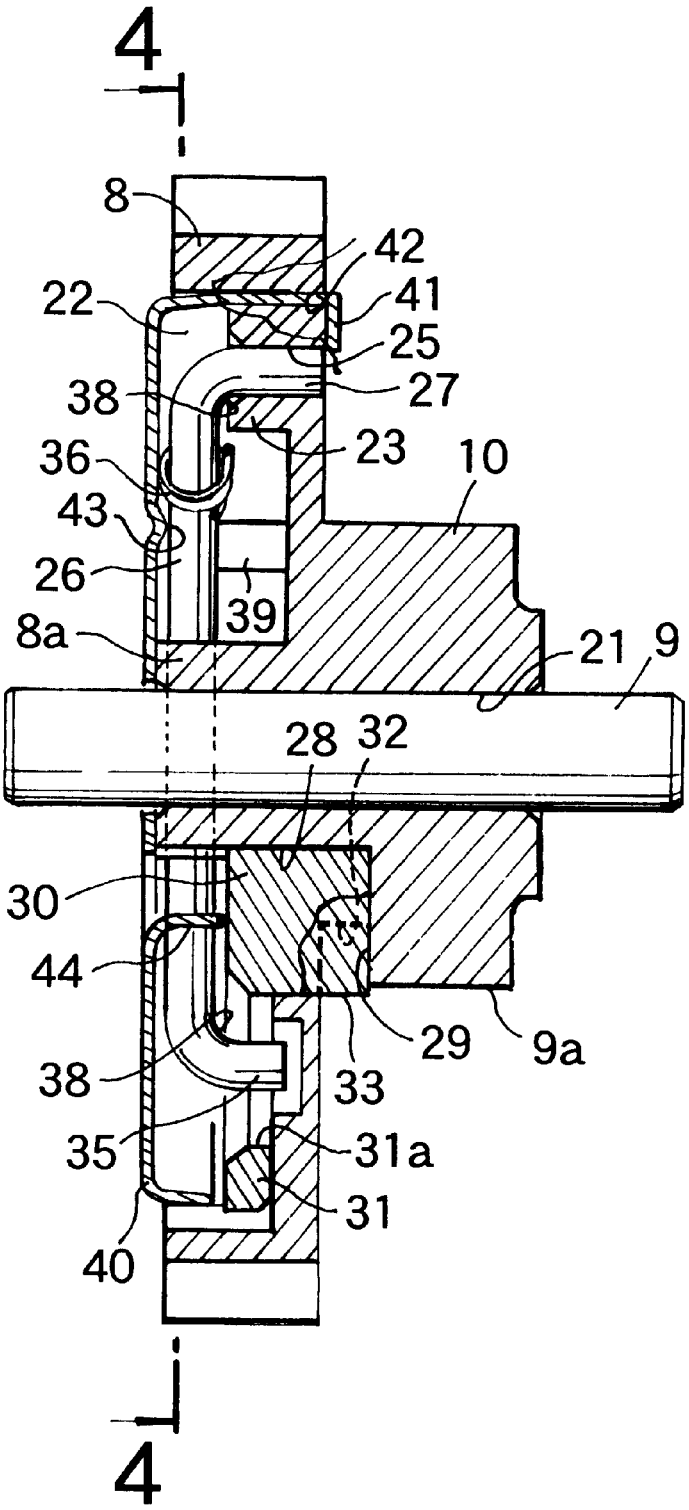
FIG. 3 is a vertical sectional view of a driven timing gear provided with a decompression mechanism taken along a line 3—3 in FIG. 4.
Figure 4:
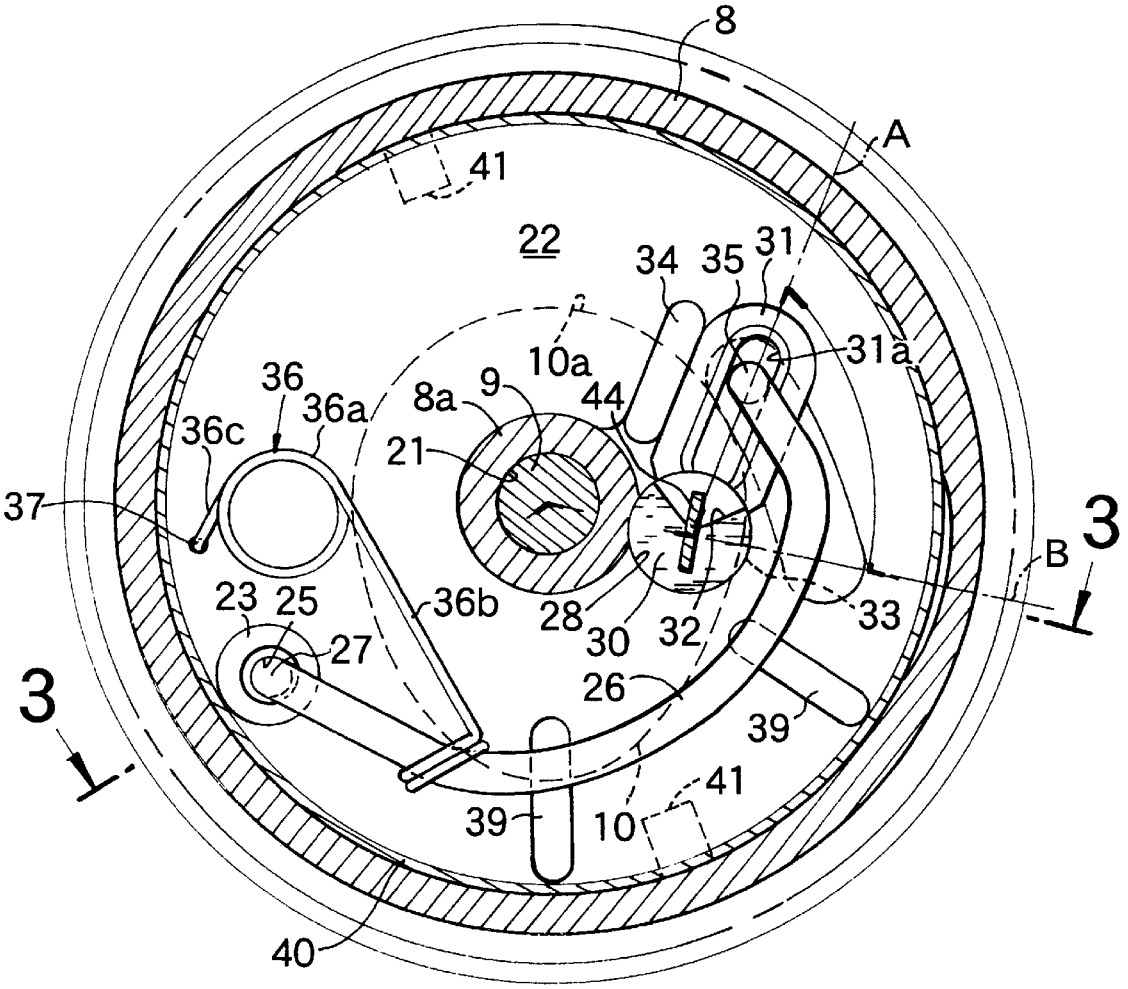
FIG. 4 is a sectional view taken along a line 4—4 in FIG. 3.

In FIGS. 3 and 4, a series of support bores 21 are provided in a boss 8*a* of the driven timing gear 8 and the cam 10, and the intermediate shaft 9 is rotatably received in the support bores 21. An annular recess 22 is defined in an end face of the driven timing gear 8 on the opposite side from the cam 10, the recess 22 surrounding the boss 8*a* of the gear 8. A decompression mechanism M is disposed in the annular recess 22. The mechanism will be described below.

A small boss 23 projects from an inner end face of the annular recess 22 in the driven timing gear 8 in proximity to an inner peripheral surface of the annular recess 22. A pivot 27 of a centrifugal weight 26 is rotatably fitted in a pivot bore 25 in the small boss 23 and extends in parallel to the support bores 21.

A shaft bore 28 in an inner end wall of the annular recess 22 extends parallel to the support bores 21, adjacent the boss 8*a* of the driven timing gear 8. The shaft bore 28 starts to extend from the inner end face of the annular recess 22 and terminates in the middle of the cam 10. An opening 29 is defined in the base face 10*a* of the cam 10. A decompression cam shaft 30 is rotatably fitted in the shaft bore 28. The decompression cam shaft 30 has a notch 32 defined in a peripheral surface thereof, and also has a lever 31 integrally formed at one end thereof and disposed in the annular recess 22. The lever 31 is swung between a first position A, and a second position B which is spaced apart from the first position A by a predetermined angle (90° in the illustrated embodiment) toward the small boss 23 around axes of the support bores 21. When the lever 31 is in the first position A, a portion of the periphery of the decompression cam shaft 30 protrudes from the opening 29 outwards of the base face of the cam 10, to form a very small lift portion 33. When the lever 31 is in the second position B, the very small lift portion 33 is retracted, and the notch 32 of the decompression cam shaft 30 faces the opening 29 (see FIG. 5). The first position A of the lever 31 is determined by abutment of the lever 31 against a stopper wall 34 projecting from the inner end face of the annular recess 22. How to determine the second position B will be described hereinafter.

The lever 31 is provided with an elongated bore 31*a* extending in the lengthwise direction of the lever 31, and an operating pin 35 is formed at a tip end of the centrifugal weight 26, and is engaged into the elongated bore 31*a*.

The centrifugal weight 26, the pivot 27 and the operating pin 35 are integrally formed as a single piece from a single steel wire. More specifically, the centrifugal weight 26 is formed by curving the steel wire with a curvature larger than that of the inner peripheral surface of the annular recess 22, and the pivot 27 and the operating pin 35 are formed by bending the steel wire from opposite ends of the formed centrifugal weight 26 in one side-wise direction.

Thus, the pivot 27 is inserted into the pivot bore 25 in the driven timing gear 8; the operating pin 35 is inserted into the elongated bore 31*a* in the lever 31, and the centrifugal weight 26 is disposed along the inner peripheral surface of the annular recess 22. When the lever 31 occupies the first position A, the centrifugal weight 26 is opposed to the inner peripheral surface of the annular recess 22 at a given distance therefrom, but when the centrifugal weight 26 is swung about the pivot 27 to abut against the inner peripheral surface of the annular recess 22, it causes the lever 31 to be operated to the second position B through the operating pin 35. The second position B of the lever 31 is determined by abutment of the centrifugal weight 26 against the inner peripheral surface of the annular recess 22.

A decompression spring 36 is connected to the centrifugal weight 26 for biasing the centrifugal weight 26 toward the first position A of the lever 31. The decompression spring 36 is a torsion coiled spring. In this embodiment, an arm portion 36*b* extending from one end of a coil portion 36*a* of the spring 36 is wound around the centrifugal weight 26, and a bent tip end of an arm portion 36*c* extending from the other end of the coil portion 36*a*, is locked in a small bore 37 in the inner end wall of the annular recess 22. By winding the arm portion 36*b* around the centrifugal weight 26 as described above, the centrifugal weight 26 and the decompression spring 36 form a single assembly.

Round angle portions 38 result in bent portions between the centrifugal weight 26 and the pivot 27 as well as the operating pin 35, and it is necessary to limit the depth of fitting of the pivot 27 and the operating pin 35 into the pivot bore 25 and the elongated bore 31*a* in order to prevent such round angle portion 38 from biting into the pivot bore 25 and the elongated bore 31*a*. For the purpose of limiting the depth, limiting wall members 39 project from the inner end face of the annular recess 22 to abut against the side of the centrifugal weight 26 on the side of protrusion of the pivot 27 and the operating pin 35 for relative sliding movements.

A lid 40 made of a steel plate, is fitted into the annular recess 22 to close the opened surface of the annular recess 22. The depth of fitting of the lid 40 is limited by abutment of the inner surface of the lid 40 against the end face of the driven timing gear 8. The lid 40 has a single locking piece 41 or a plurality of locking pieces 41 protruding from a peripheral edge of the lid 40. The lid 40 is secured to the gear 8 by inserting the locking piece 41 into a locking bore 42 in the driven timing gear 8 and bending a tip end of the locking piece 41. A small projection 43 and a cut/raised piece 44 are formed on the lid 40 for preventing the centrifugal weight 26 and the decompression cam shaft 30 from falling out.

The operation of this embodiment will be described below.

Figure 5:
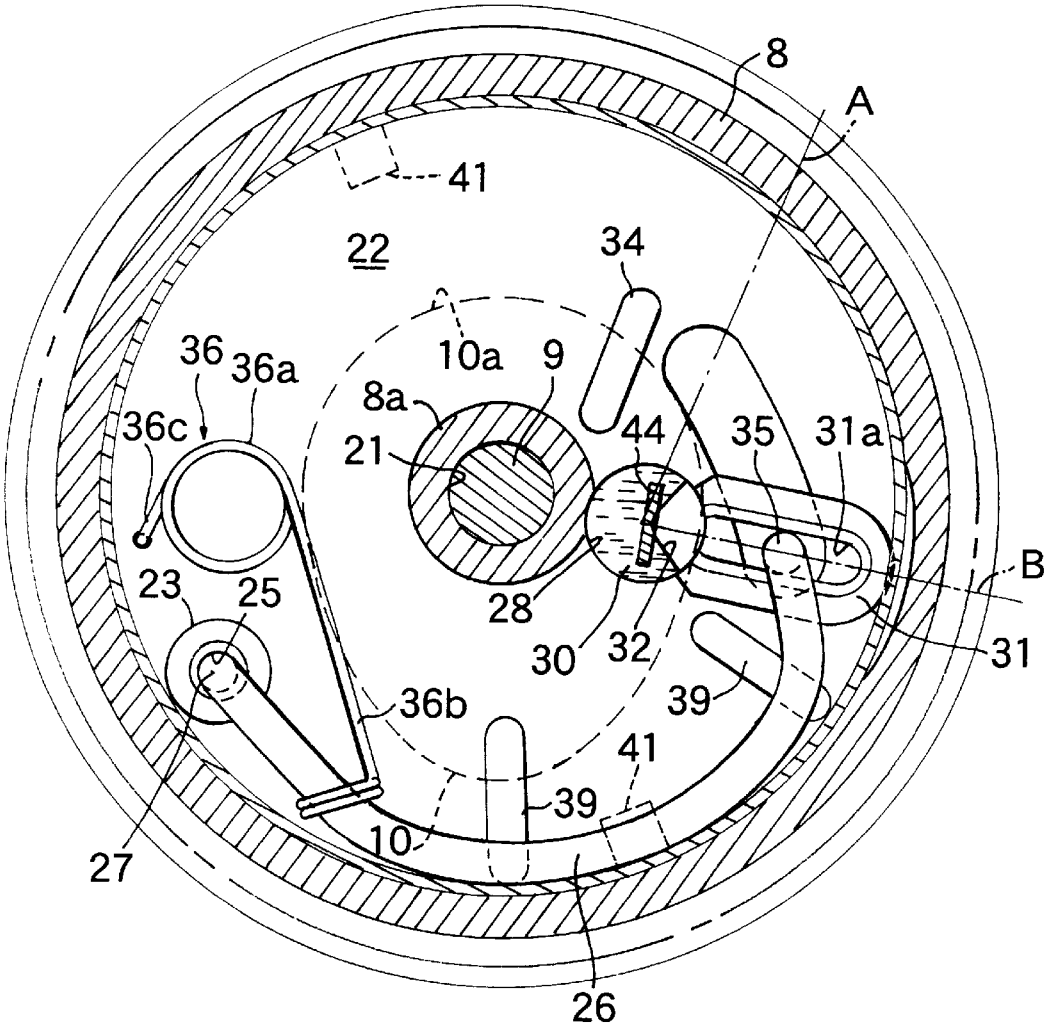
FIG. 5 is a view similar to FIG. 4, but for explaining the operation.
Figure 6:
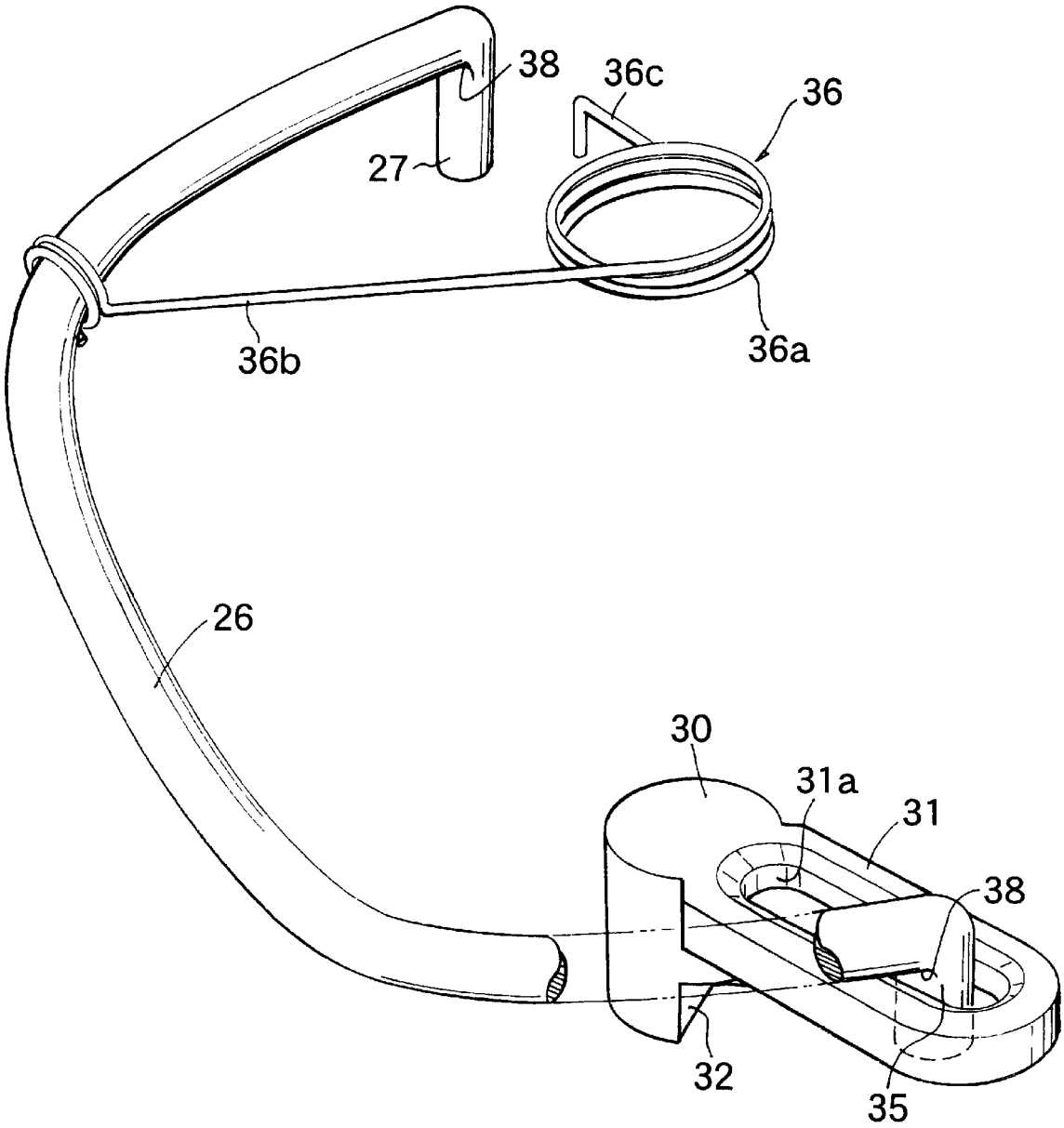
FIG. 6 is a perspective view of an essential portion of the decompression mechanism.

In an operation-stopped state of the engine, the centrifugal weight 26 occupies the position where it is spaced apart from the inner peripheral surface of the annular recess 22 in the driven timing gear 8, under the action of the biasing force of the decompression spring 36, as shown in FIGS. 4 and 5 and hence, the lever 31 is retained at the first position A by the operating pin 35. As a result, a peripheral surface of a portion of the decompression cam shaft 30 protrudes from the opening 29 onto the base face of cam 10 to form the very small lift portion 33.

Thereupon, when for example, a recoiled starter is manually operated to crank the crankshaft 3 in order to start the engine, the very small lift portion 33, i.e., the peripheral surface of the portion of the decompression cam 10, slightly pushes up the push rods 17 and 18 through the cam followers 12 and 13 in a compression stroke of the engine in which the base face 10*a* of the cam 10 passes through the cam followers 12 and 13. This causes the intake and exhaust valves 4 and 5 to be slightly opened, so that a portion of the pressure of compression in the combustion chamber in the engine is released to the outside to moderate the cranking load and hence, it is possible to smoothly perform the starting operation.

When the engine is started and the rotational speed of the driven timing gear 8 is increased to a predetermined value or higher, the centrifugal weight 26 is swung about the pivot 27 against a preset load of the decompression spring 36 by an increase in centrifugal force acting on the centrifugal weight 26, thereby swinging the lever 31 to the second position B through the operating pin 35, as shown in FIG. 5. Thus, the decompression cam shaft 30 causes the very small lift 33 to be retracted, permitting the notch 32 to face the opening 29 in the cam 10. As a result, the cam 10 enables the intake and exhaust valves 4 and 5 to be properly opened and closed in accordance with an intrinsic cam profile without being interfered with by the decompression cam shaft 30.

In the decompression mechanism M, the centrifugal weight 26, the pivot 27 and the operating pin 35 are formed as the single piece by bending the single steel wire and hence, it is possible to easily fabricate the decompression mechanism M from a reduced number of parts, thereby providing a reduction in cost of the decompression mechanism M.

Moreover, since the depth of fitting of the pivot 27 and the operating pin 35 into the pivot bore 25 and the elongated bore 31 a is limited by the limiting wall members 39 projecting from the inner end face of the annular recess 22, the biting of the round angle portions 38 inside the bends between the centrifugal weight 26 and the pivot 27 as well as the operating pin 35 into the pivot bore 25 and the elongated bore 31*a* respectively can be avoided, and the operation of the centrifugal weight 26 can always be smoothly performed.

Further, since the falling out of the centrifugal weight 26 and the decompression cam shaft 30 is prevented by the lid 40 closing the annular recess 22, a member exclusively used to prevent falling out, such as a circlip and a split pin, is not required, and this further simplifies the structure.

Figure 7:
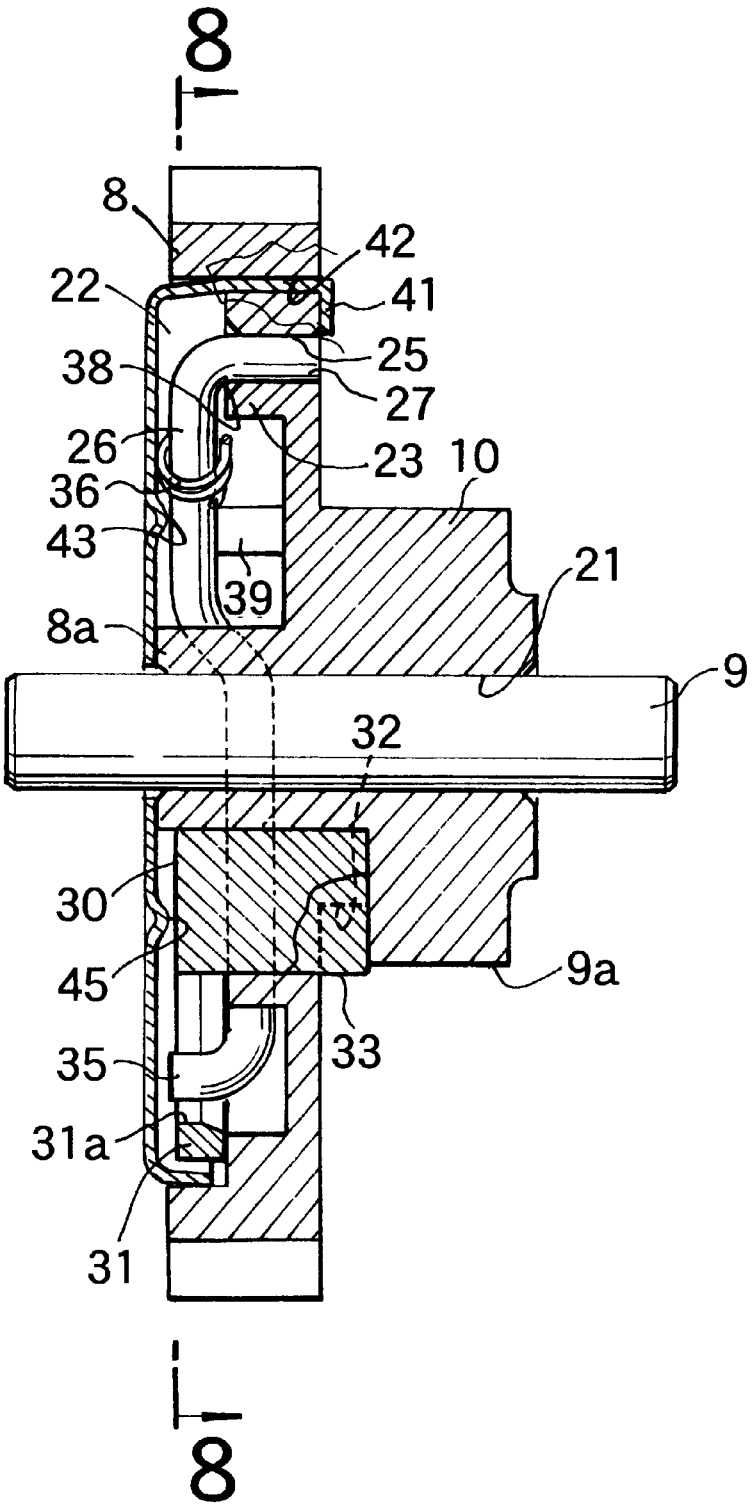
FIG. 7 is a sectional view similar to FIG. 3, but illustrating a second embodiment of the present invention.
Figure 8:
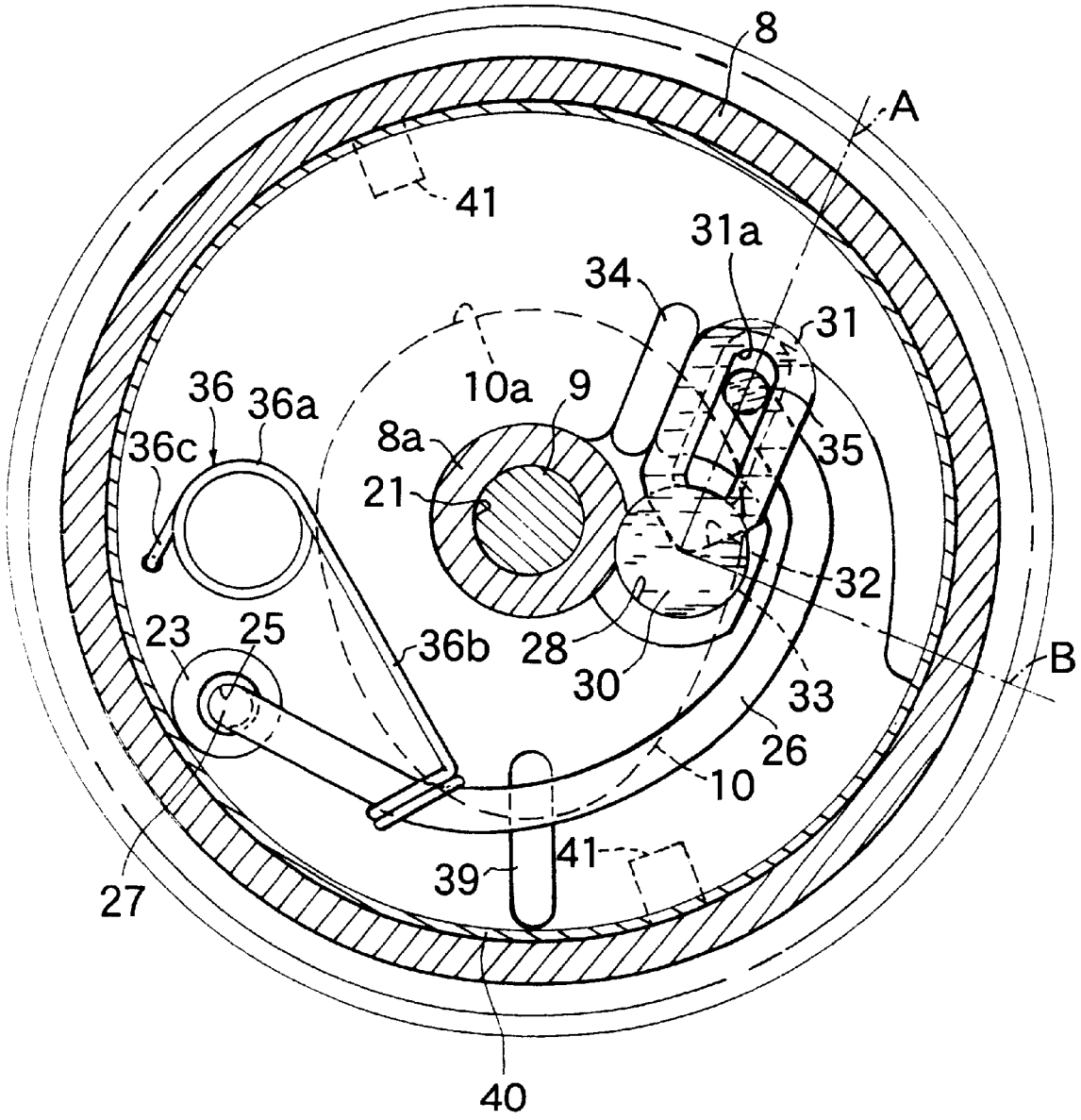
FIG. 8 is a sectional view taken along a line 8—8 in FIG. 7.

FIGS. 7 and 8 show a second embodiment of the present invention. In this embodiment, the decompression cam shaft 30 is longer than that in the previous embodiment, so that the lever 31 is located in proximity to the inner surface of the lid 40. Thus, it is possible to prevent the falling out of the decompression cam shaft 30 by a small projection 45 of the lid 40. In this case, the centrifugal weight 26 is bent into a crank-like shape in the axial direction of the driven timing gear 8, and the operating pin 35 protrudes in an opposite direction from the pivot 27 and is engaged in the elongated bore 31*a* from inside the lever 31. The other construction is similar to that in the previous embodiment and hence, in FIGS. 7 and 8, portions or components corresponding to those in the previous embodiment are designated by like reference characters and the description of them is omitted.

In the illustrated embodiments, the cam followers 12 and 13 in the intake and exhaust systems are operated by the decompression cam shaft 30. Alternatively, only the cam follower 13 in the exhaust system may be operated. As discussed above, the centrifugal weight, the pivot bent sideways from one end of the centrifugal weight and the operating pin bent sideways from the other end of the centrifugal weight are integrally formed from a single steel wire. Therefore, the centrifugal weight, the pivot and the operating pin can be simply formed as a single piece by bending the single steel wire, and it is easy to manufacture the decompression mechanism, and the number of parts is decreased, which can contribute substantially to a reduction in cost.

A limiting wall member is integrally formed on the driven timing gear to abut against the centrifugal weight to limit the depth of fitting of the pivot into the pivot bore. Therefore, even if a round angle portion is left inside the bend between the centrifugal weight and the pivot, the round angle portion can be prevented from biting into the pivot bore by the limiting wall member, and a smooth swinging movement of the centrifugal weight can be ensured.

The present invention is not limited to the above-described embodiments, and various modifications in design may be made without departing from the subject matter of the present invention.

We claim:

1. A decompression mechanism in an engine having a driven timing gear, said mechanism comprising an annular recess formed in one end face of said driven timing gear, a cam for opening and closing an engine valve connected to the other end face of said driven timing gear; a decompression cam shaft extending from said annular recess to said cam and rotatable between a first position wherein a vary small lift portion is formed on a base face of said cam and a second position wherein said very small lift portion is retracted; a centrifugal weight positioned in said annular recess; a pivot integrally formed at a base end of said centrifugal weight; a pivot bore in said driven timing gear wherein said pivot is fitted into said pivot bore; an operating pin formed at a tip end of said centrifugal weight and engaged with said decompression cam shaft, wherein said decompression cam shaft can be rotated from the first position to the second position by a centrifugal operation of said centrifugal weight; and a decompression spring connected to said centrifugal weight for biasing said centrifugal weight toward the first position, wherein said centrifugal weight, said pivot bent sideways from one end of said centrifugal weight and said operating pin bent from the other end of said centrifugal weight are integrally formed.

2. A decompression mechanism in an engine according to claim 1, wherein said centrifugal weight, said pivot and said operating pin are integrally formed from a single piece of wire.

3. A decompression mechanism in an engine according to claim 1, further including at least one limiting wall member integrally formed on said driven timing gear for abutting against said centrifugal weight to limit a depth of fitting of said pivot into said pivot bore.

* * * * *

UNITED STATES PATENT AND TRADEMARK OFFICE

CERTIFICATE OF CORRECTION

PATENT NO. : 5,943,992

DATED : August 31, 1999

INVENTOR(S) : Hiroaki Kojima, et al.

It is certified that error appears in the above-identified patent and that said Letters Patent is hereby corrected as shown below:

Column 6, line 26, change "vary" to --very--.

Signed and Sealed this

Sixteenth Day of May, 2000

*Attest:*

Q. TODD DICKINSON

*Attesting Officer*

*Director of Patents and Trademarks*